US006034580A

United States Patent [19]

Henderson et al.

[11] Patent Number: 6,034,580

[45] **Date of Patent: *Mar. 7, 2000**

[54] COPLANAR WAVEGUIDE FILTER

[75] Inventors: Bert C. Henderson, Sunnyvale; Malkiat Nijjar, San Jose, both of Calif.

[73] Assignee: Endgate Corporation, Sunnyvale, Calif.

[ * ] Notice: This patent is subject to a terminal disclaimer.

[21] Appl. No.: 09/298,812

[22] Filed: Apr. 23, 1999

Related U.S. Application Data

[63] Continuation of application No. 08/997,338, Dec. 23, 1997, abandoned, which is a continuation of application No. 08/709,274, Sep. 6, 1996, Pat. No. 5,770,987.

[51] Int. Cl.[7] ..... H01P 1/203; H01P 3/08

[52] U.S. Cl. ..... 333/204; 333/219

[58] Field of Search ..... 333/204, 219, 333/205, 236, 246

[56] References Cited

U.S. PATENT DOCUMENTS

| | | | |
|---|---|---|---|
| 3,605,045 | 9/1971 | Ramsbotham, Jr. | 333/204 |
| 3,805,198 | 4/1974 | Gewartowski et al. | 33/204 |
| 4,313,095 | 1/1982 | Jean-Frederic | 333/116 |
| 5,461,352 | 10/1995 | Noguchi et al. | 333/204 |
| 5,770,987 | 6/1998 | Henderson | 333/204 |

*Primary Examiner*—Seungsook Ham
*Attorney, Agent, or Firm*—Steven J. Adamson; Edward B. Anderson

[57] ABSTRACT

A coplanar band pass filter having a centerline formed of at least first and second serially arranged conducting segments which are separated by a gap. The centered segments are flanked by a resonator for coupling return current from the first and second segments. Conducting members that may include conductive strips or conductive planes are respectively provided on opposing sides of the resonator and centerline. Band pass elements may be provided in the conductive strips or planes to reduce or eliminate spurious pass band frequencies.

16 Claims, 1 Drawing Sheet

Fig. 1
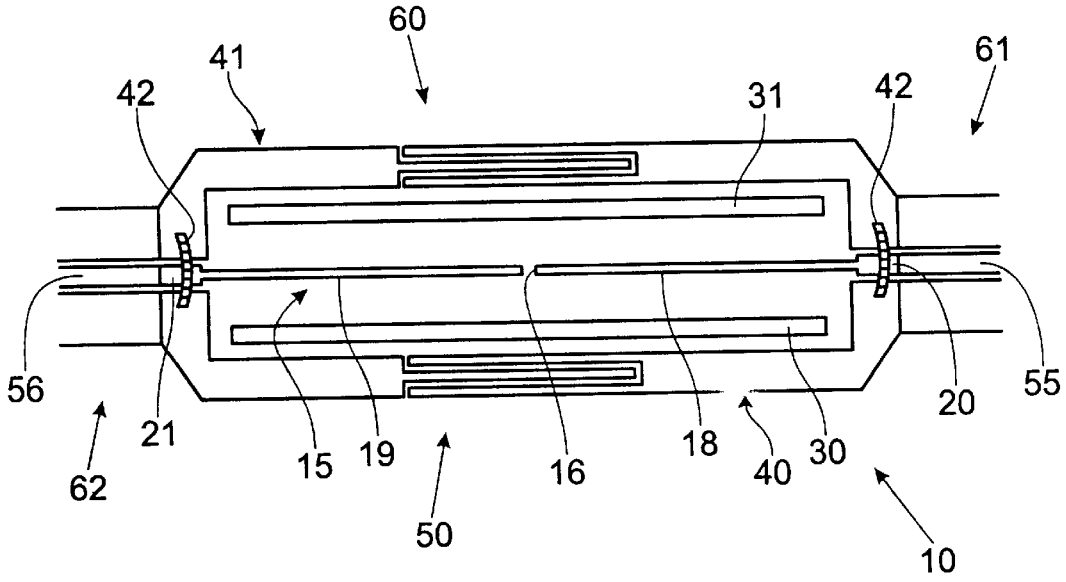
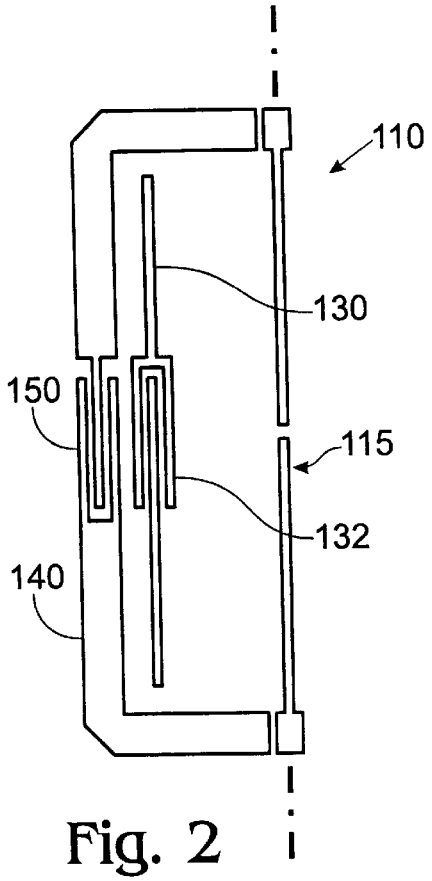
Fig. 2
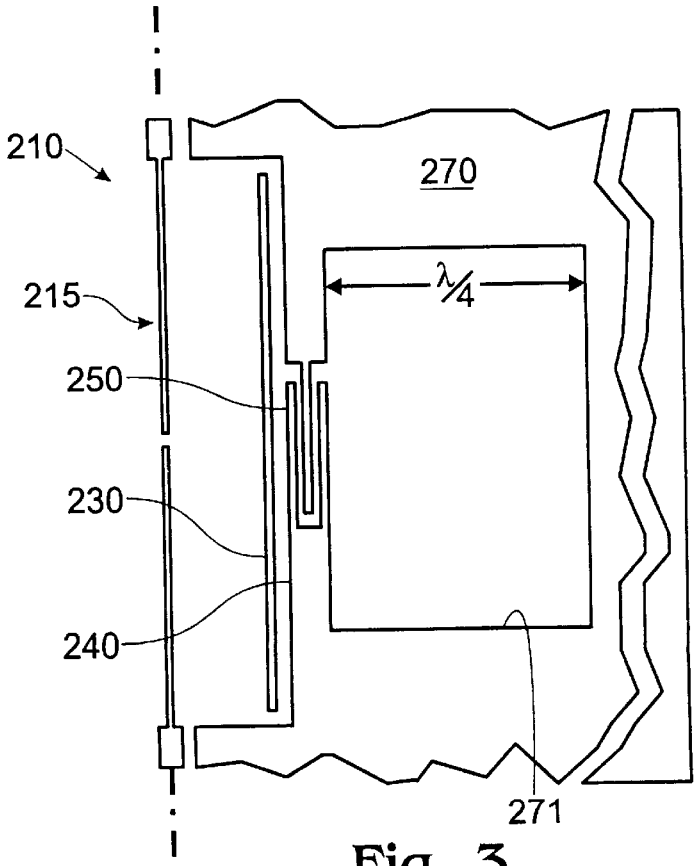
Fig. 3

COPLANAR WAVEGUIDE FILTER

CROSS REFERNCE TO RELATED APPLICATIONS

This application is a continuation of Ser. No. 08/997,338, filed Dec. 23, 1997, now abandoned, which is a continuation of Ser. No. 08/709,274, filed Sep. 6, 1996, now U.S. Pat. No. 5,770,987.

FIELD OF THE INVENTION

The present invention relates to band pass and AC pass filters and, more specifically, to reducing spurious pass band frequencies and other deleterious effects in such filters.

BACKGROUND OF THE INVENTION

For use in microwave integrated circuits (MIC) and monolithic microwave integrated circuits (MMIC), band pass filters such as the Ribbon-of-Brick-Wall (RBW) filter described in Coplanar Waveguide Bandpass Filter—A Ribbon-of-Brick-Wall Design, by Lin et al., IEEE, 1995, have been proposed.

The RBW coplanar waveguide (CPW) filter comprises a centerline surrounded by two ground planes in which a portion of the centerline is configured to have a quarter wavelength open ended stub conductor flanked by quarter wavelength open-ended stub resonators.

The RBW CPW filter of Lin et al. represents an improvement over prior art microstrip filters with respect to ease of series and shunt connections, absence of via holes, insensitivity to substrate thickness, and low dispersive effects. Notwithstanding these improvements however, the design of Lin et al. is disadvantageous in that it may permit propagation of spurious pass bands and DC bias voltages, and may suffer from moding which results in significant reductions in gain at frequencies corresponding to quarter wavelength multiples of the ground plane length.

In addition, conventional coplanar devices have expansive ground planes which take up a disadvantageously large amount of substrate area.

SUMMARY OF THE INVENTION

Accordingly, it is an object of the present invention to provide a coplanar filter having a compact design.

It is another object of the present invention to provide a coplanar filter that reduces or eliminates spurious pass band frequencies.

It is yet another object of the present invention to provide a coplanar filter that passes certain AC signals and prohibits propagation of DC bias or other DC voltage signals.

These and related objects of the present invention are achieved by use of the coplanar filter herein described.

In one embodiment of the present invention, a coplanar filter is provided that is configured in CPW strip so as to provide a more compact design, reduce requisite materials and eliminate moding. A physical gap is provided in the center conductor and each of the strip conductors. The physical gaps nat be formed as capacitators, which pass AC signals in a particular range. The capacitators may be distributed or interdigitated.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIG. 1 is a diagram of a coplanar filter in accordance with the present invention.

FIG. 2 is a diagram of a portion of a coplanar filter having a band pass element within a resonator in accordance with the present invention.

FIG. 3 is a diagram of a portion of a coplanar filter configured in conventional CPW in accordance with the present invention.

DETAILED DESCRIPTION

The present invention may be implemented in microwave integrated circuits (MIC), monolithic microwave integrated circuits (MMIC), and multi-chip modules (MCM) or multi-chip integrated circuits (MCIC). It is well suited for microwave and millimeter wave applications, and is directly scalable to other frequencies.

Referring to FIG. 1, a diagram of a coplanar waveguide (CPW) band pass filter 10 is accordance with the present invention is shown. Filter 10 is designed to pass AC signals in a particular pass band and to block both AC signals outside the pass band and DC signals.

The filter 10 includes a centered printed trace referred to herein as a centerline 15 which is separated by gap 16 into first 18 and second 19 segments. Gap 16 blocks propagation of DC signals. The first segment 18 narrows from a base 20 at which it is connected to a centerline 55 of an input coplanar waveguide (CPW) transmission line 61. The second segment 19 similarly narrows from base 21 at which it is coupled to a centerline 56 of an output CPW transmission line 62. The first and second segments are preferably approximately a quarter of a design wavelength in length. Their width and the length of gap 16 may be dependent on photolithographic tolerances. The narrowing of segments 18, 19 from their connection to the CPW transmission media to gap 16 provides a desired up transformation of impedance. For other applications, segments 18, 19 could be configured such that they maintain their shape or expand, thus providing no impedance transformation or a downward transformation, respectively.

The centerline 15 is flanked by a pair of resonators 30, 31 which are preferably centered about gap 16. Each resonator is preferably approximately one-half of a design wavelength in length.

A conducting member 40 is provided adjacent to and generally in a spaced parallel relationship with resonator 30, on the side opposite that of centerline 15, while a conducting member 41 is provided adjacent to and preferably in a spaced parallel relationship with resonator 31, on the side opposite that of centerline 15. The conducting members 40, 41 are connected to and form part of the conductive strips of the CPW strip transmission lines 61, 62. Bond wires 42 electrically interconnect the conducting members 40, 41. It should be recognized that the use of conductive strips as opposed to a conventional conducting plane provides a more compact design, requires less material and eliminates moding. The conducting members 40, 41 and the strips to which they connect preferably have a width of a quarter wavelength of a frequency greater than a design frequency of the filter. The spacing of the resonators from both segments 18, 19 and conducting members 40, 41 provides a ratio of capacitive values that defines a bandwidth of the filter.

Each conducting member 40, 41 includes a band pass element 50, 60 for more precisely tuning the frequency response of band pass filter 10. The band pass elements 50,

60 are preferably positioned in a region of the conducting member centered about gap 16 (i.e., they are provided where resonators 30, 31 are coupling current from first segment 18 to second segment 19). Additionally, the band pass elements 50, 60 are preferably configured as capacitors and thus are theoretically high pass elements which reject spurious frequencies below a desired pass frequency. Parasitic inductance associated with capacitive elements, however, also provides rejection of bands above a desired pass band, thereby effectively making the capacitors band pass elements. Since the band gap in conductive material, these elements also block propagation of DC signals.

The embodiment of FIG. 1 illustrates the band pass elements implemented as distributed capacitors of three coupled lines. It should be recognized that other distributed capacitor configurations may be used such as two coupled lines, interdigitated, angled-rectilinear and non-rectilinear patterns and the like. Design criteria for creating a suitable configuration include providing a desired amount of capacitance in a minimal amount of substrate area.

It should also be recognized that other capacitive devices could be used for implementing a band pass element 50, 60 and these include chip mounted parallel plate and reverse diode configurations and the like. Planar patterned band pass elements may be preferred, however, since they do not require additional device mounting steps.

The components of filter 10 recited above are made of a suitable conductive material, such as gold (Au), and are formed on a substrate of suitable dielectric material, such as BeO, AlN, GaAs, etc.

Filter 10 and filters 110 and 210 described below are preferably designed using field solving software known in the art such as that provided by Zeland Software, Inc., of San Francisco, Calif.

A CPW strip configuration is utilized because conventional CPW ground planes can produce moding which results in significant reductions in gain at frequencies corresponding to quarter wavelength multiples of the ground plane length. The widths of the non-centerline conductive strips of CPW strip transmission lines 61, 62 preferably correspond to quarter wavelengths of frequencies significantly above that of the filter's design frequency. For example, if filter 10 is designed to operate at 50 GHz, the strips are preferably designed to have widths that are a quarter wavelength of 150 GHz or more.

Configuring the CPW signal return conductors as strips also achieves DC signal blockage (in conjuction with the "gapped" center conductor) by providing a physical gap in each strip conductor.

In operation, AC current in filter 10 propagates through input CPW centerline 55 into first segment 18. Gap 16 stops current flow in the centerline, thereby preventing further propagation of current other than that which is of a suitable frequency to couple to resonators 30, 31.

Current coupled from segment 18 to resonators 30, 31 propagates along resonators 30, 31 from the region where it is coupled from first segment 18 to a region where it is coupled to segment 19. The current in resonators 30, 31 also generates a corresponding current in conducting members 40, 41, respectively. Current coupled to the second segment 19 propagates to output CPW centerline 56.

Computer field solver analysis and empirical evidence has indicated that reducing current density in the center of conducting members 40, 41, eliminates spurious pass band frequencies. Current density reduction is achieved by use of band pass elements 50, 60 which restrict the band of AC current which propagates along conducting members 40, 41. Band pass elements 50, 60 are preferably located in a region of conducting members 40, 41 corresponding to the location of gap 16.

It should be noted that although the embodiment of FIG. 1 includes two centerline segments and two resonator elements, different centerline and resonator configurations are possible. The provision of band pass elements in the conductive members to reduce current density therein is the same regardless of the number or configuration of centerline and resonator components.

It should be further recognized that serial connection of two of the filters 10 of FIG. 1 achieves twice the out-of-band filter rejection, but at the expense of doubling in-band insertion loss.

Other Embodiments

Reducing current density in the conducting members at selected frequencies achieves a desired elimination of spurious frequency pass bands. Reducing this current density may be achieved by providing a band pass element in conductive members 40, 41 as illustrated above. Conducting member current density can also be reduced by providing a band pass element in resonators 30, 31 to thereby reduce current coupled to the conducting members.

Referring to FIG. 2, an diagram of a portion of a coplanar band pass filter 110 having a band pass element 132 in the resonator is shown. Approximately half of filter 110 is shown and that part which is not shown is symmetric about centerline 115 as in filter 10 of FIG. 1. The band pass element 132 is provided in resonator 130 to select the frequency band of current propagating along the resonator and the frequency band of current coupled to conducting member 140. Filter 110 can be realized with or without the band pass element 150, though without band pass element 150 the filter would not function as a DC block.

Although a three coupled line distributed capacitor is shown for element 132, other configurations and band pass elements as discussed above may be used.

The filter embodiments disclosed in FIGS. 1–2 are configured in CPW strip. The present invention may also be configured in conventional CPW with characteristically expansive ground planes.

Referring to FIG. 3, an assembly diagram of a portion of a coplanar band pass filter 210 configured in conventional CPW in accordance with the present invention is shown. Approximately half of filter 210 is shown and the part that is not shown is symmetric about centerline 215 from that which is shown.

The filter 210 includes a conventional ground plane 270 that is illustrated with a wavy line border to indicate that the ground plane extends beyond the surface area allotted in FIG. 3. An opening 271 is created in ground plane 270 to define a conducting member 240. Opening 271 is approximately one quarter of a design wavelength or longer in a dimension perpendicular to centerline 215. Opening 271 serves to reduce or eliminate short circuit passage of spurious frequencies in the ground plane by effectively channelling current through conducting member 240 which contains a band pass element 250. The band of operation of filter 210 is more narrow than that of filter 10.

The band pass element 250 is configured in a manner analogous to band pass elements 50, 60 of FIG. 1. Resonator 230 provides the same function as resonator 30 of FIG. 1.

It should be recognized that filter 210 of FIG. 3 does not provide DC block because of the continous signal return plane.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A coplanar waveguide filter, comprising:

a substrate;

a center conductor arrangement formed on said substrate that comprises at least a first conducting member and a second conducting member that are physically separated from one another, said center conductor arrangement being configured to pass AC signals of a given frequency from said first conducting member to said second conducting member;

a first signal return conducting strip formed on said substrate adjacent said center conductor arrangement on a first side thereof, said first signal conducting strip including a first conducting member and a second conducting member that are physically separated from one another, yet indirectly electrically coupled so as to permit coupling of AC signals of a given frequency from said first member to said second member; and a second signal return conducting strip formed on said substrate adjacent said center conductor arrangement on a second side thereof that is generally opposite said first signal return conducting strip, said second signal conducting strip including a first conducting member and a second conducting member that are physically separated from one another, yet indirectly electrically coupled so as to permit coupling of AC signals of a given frequency from said first member to said second member.

2. The filter of claim 1, wherein the physical separations of said center conductor arrangement and said first and second conducting members are substantially aligned.

3. The filter of claim 1, wherein said first and said second signal return conducting strips are configured to reduce moding.

4. The filter of claim 1, wherein said first conducting member and said second conducting member of said center conductor arrangement are part of a band pass circuit.

5. The filter of claim 3, wherein said conducting strips have a width of approximately a quarter wavelength of a frequency greater than a design frequency of said filter.

6. The filter of claim 1, wherein portions of said first conducting member and said second conducting member of said first signal return conducting strip overlap for propagation of AC signals of a given frequency.

7. The filter of claim 6, wherein portions of said first conducting member and said second conducting member of said second signal return conducting strip overlap for propagation of AC signals of a given frequency.

8. The filter of claim 1, wherein said first signal return conducting strip includes a first band pass element.

9. The filter of claim 8, wherein said second signal return conducting strip includes a second band pass element.

10. The filter of claim 9, wherein said first band pass elements are capacitors.

11. The filter of claim 1, wherein said first and second signal return conducting strips have a width of approximately a quarter wavelength of a frequency greater than that of a design frequency of said filter.

12. A coplanar waveguide filter, comprising:

a substrate;

a center conductor formed on said substrate that is configured to define a first gap that physically separates an input conductive portion from an output conductive portion thereof;

a first signal return conducting strip formed on said substrate adjacent said center conductor that is configured to define a second gap that physically separates an input conductive portion from an output conductive portion thereof; and a second signal return conducting strip formed on said substrate adjacent said center conductor and opposite said first conducting strip that is configured to define a third gap that physically separates an input conductive portion from an output conductive portion thereof;

wherein said input conductive portions of said center conductor, said first signal return conducting strip and said second signal return conducting strip are coupled to an input of said filter and said output conductive portions of said center conductor, said first signal return conducting strip and said second signal return conducting strip are coupled to an output of said filter; and wherein each of said center conductor and said first and second conducting strips are configured to propagate AC signals of a given frequency and to block DC signals due to said first, second and third physical gaps.

13. The filter of claim 12, wherein said input portion and said output portion of said first signal return conducting strip overlap at least in part for propagation of AC signals of a given frequency.

14. The filter of claim 13, wherein said input portion and said output portion of said second signal return conducting strip overlap at least in part for propagation of AC signals of a given frequency.

15. The filter of claim 12, wherein said first, second and third gaps are substantially aligned with one another.

16. The filter of claim 12, wherein said first and second signal return conductive strips are configured to reduce moding.

* * * * *